US010150582B2

(12) United States Patent
Yamada et al.

(10) Patent No.: US 10,150,582 B2
(45) Date of Patent: Dec. 11, 2018

(54) METHOD OF MAKING COMPOSITIONS COMPRISING MULTIPLE LAYERS

(75) Inventors: Kosaku Yamada, Kobe (JP); Toshiya Taniguchi, Kobe (JP); Takashi Yoshida, Kobe (JP); Kazunori Ogami, Kobe (JP)

(73) Assignee: Noxell Corporation, Hunt Valley, MD (US)

( * ) Notice: Subject to any disclaimer, the term of this patent is extended or adjusted under 35 U.S.C. 154(b) by 685 days.

(21) Appl. No.: 13/189,825

(22) Filed: Jul. 25, 2011

(65) Prior Publication Data

US 2012/0024420 A1 Feb. 2, 2012

Related U.S. Application Data

(60) Provisional application No. 61/367,886, filed on Jul. 27, 2010.

(51) Int. Cl.

| | |
|---|---|
| ***B65B 3/04*** | (2006.01) |
| ***B65B 43/62*** | (2006.01) |
| *B65B 39/00* | (2006.01) |

(52) U.S. Cl.

CPC ..... *B65B 3/04* (2013.01); *B65B 43/62* (2013.01); *B65B 2039/009* (2013.01); *B65B 2220/14* (2013.01); *B65B 2220/24* (2013.01)

(58) Field of Classification Search

CPC ..... B65B 3/26; B65B 2220/14; B29C 39/025

(Continued)

(56) References Cited

U.S. PATENT DOCUMENTS 4,966,205 A 10/1990 Tanaka
4,970,252 A * 11/1990 Sakuta et al. ..... 524/268

(Continued)

FOREIGN PATENT DOCUMENTS

DE 202006014779 U1 12/2006
EP 1602579 A1 12/2005

(Continued)

OTHER PUBLICATIONS

"Canadian Application Serial No. 2,804,630 Response Filed Jan. 24, 2017 to Office Action dated Jul. 27, 2016", 11 pgs.

(Continued)

*Primary Examiner* — Timothy L Maust
*Assistant Examiner* — Timothy P Kelly
(74) *Attorney, Agent, or Firm* — Schwegman Lundberg & Woessner, P.A.

(57) ABSTRACT

A method of making a personal care composition by providing a first layer and a second layer which each are fluid at elevated temperature; solid at ambient temperature; and visually distinctive from each other; providing the first and second layers in fluid state at an elevated temperature in isolated vessels; separately dispensing the first layer by a first nozzle and the second layer by a second nozzle, while maintaining the elevated temperature, into a same package having a circle plan view shape, wherein the positions of the nozzles, relative to the center of the package, are maintained during dispensing, and wherein the middle point of the nozzles do not coincide with the Z axis running vertically through the center of the package; and cooling the dispensed composition for solidifying in the package.

6 Claims, 7 Drawing Sheets

(58) Field of Classification Search
USPC ..... 141/1, 11, 69, 82, 100, 105, 250, 270, 141/283
See application file for complete search history.

(56) References Cited

U.S. PATENT DOCUMENTS

| | | | | | |
|---|---|---|---|---|---|
| 4,980,155 | A * | 12/1990 | Shah et al. | 424/63 |
| 5,073,371 | A * | 12/1991 | Turner et al. | 424/401 |
| 5,073,372 | A * | 12/1991 | Turner et al. | 424/401 |
| 5,087,445 | A * | 2/1992 | Haffey et al. | 424/59 |
| 5,330,747 | A * | 7/1994 | Krzysik | 424/63 |
| 5,362,482 | A * | 11/1994 | Yoneyama et al. | 424/69 |
| 5,412,004 | A * | 5/1995 | Tachibana et al. | 524/27 |
| 5,429,816 | A * | 7/1995 | Hofrichter et al. | 424/66 |
| 5,505,937 | A * | 4/1996 | Castrogiovanni et al. | 424/64 |
| 5,654,362 | A * | 8/1997 | Schulz et al. | 524/862 |
| 5,760,116 | A * | 6/1998 | Kilgour et al. | 524/268 |
| 5,811,487 | A * | 9/1998 | Schulz et al. | 524/862 |
| 5,837,793 | A * | 11/1998 | Harashima et al. | 528/29 |
| 6,458,345 | B1 * | 10/2002 | Emslie et al. | 424/65 |
| 6,648,026 | B2 * | 11/2003 | Look et al. | 141/9 |
| 6,723,269 | B2 * | 4/2004 | Grosz et al. | 264/254 |
| D537,562 | S * | 2/2007 | Taniguchi et al. | D28/4 |
| D537,563 | S * | 2/2007 | Taniguchi et al. | D28/4 |
| D538,471 | S * | 3/2007 | Taniguchi et al. | D28/4 |
| 2002/0031534 | A1 * | 3/2002 | Horino | 424/401 |
| 2007/0059262 | A1 * | 3/2007 | Taniguchi | 424/63 |
| 2007/0059263 | A1 * | 3/2007 | Taniguchi et al. | 424/63 |
| 2007/0060650 | A1 * | 3/2007 | Taniguchi et al. | 514/557 |
| 2007/0060666 | A1 * | 3/2007 | Taniguchi et al. | 523/105 |
| 2008/0196787 | A1 | 8/2008 | Comstock et al. | |
| 2011/0045038 | A1 * | 2/2011 | Yamada et al. | 424/401 |
| 2011/0200718 | A1 * | 8/2011 | Swertvaegher et al. | 426/130 |

FOREIGN PATENT DOCUMENTS

| | | | |
|---|---|---|---|
| EP | 1657159 | A1 | 5/2006 |
| EP | 2177109 | A2 | 4/2010 |
| JP | 01-301611 | A | 12/1989 |
| JP | 2004-321410 | A | 11/2004 |
| JP | 2008-521880 | A | 6/2008 |
| JP | 2008-521881 | A | 6/2008 |
| JP | 2008-521882 | A | 6/2008 |
| JP | 2008-522982 | A | 7/2008 |
| JP | 2010-511053 | A | 4/2010 |
| WO | WO-2007/029152 | A2 | 3/2007 |
| WO | WO-2007/029153 | A2 | 3/2007 |
| WO | WO-2007/029154 | A2 | 3/2007 |
| WO | WO-2007/032937 | A1 | 3/2007 |
| WO | WO 2010043497 | A2 * | 4/2010 |

OTHER PUBLICATIONS

"Canadian Application Serial No. 2,804,630, Response filed Dec. 12, 2014 to Office Action dated Jun. 13, 2014", 9 pgs.
"Canadian Application Serial No. 2,804,630, Office Action dated May 7, 2015", 6 pgs.
"Canadian Application Serial No. 2,804,630, Office Action dated Jun. 13, 2014", 3 pgs.
"Canadian Application Serial No. 2,804,630, Office Action dated Jul. 27, 2016", 6 pgs.
"Canadian Application Serial No. 2,804,630, Office Action dated Oct. 25, 2013", 3 pgs.
"Canadian Application Serial No. 2,804,630, Response filed Mar. 20, 2014 to Office Action dated Oct. 25, 2013", 11 pgs.
"Canadian Application Serial No. 2,804,630, Response filed Nov. 9, 2015 to Office Action dated May 7, 2015", 6 pgs.
"Chinese Application Serial No. 201180036161.0, Office Action dated Feb. 13, 2015", (with English Translation), 15 pgs.
"Chinese Application Serial No. 201180036161.0, Office Action dated Apr. 30, 2014", (w/ English Translation), 18 pgs.
"Chinese Application Serial No. 201180036161.0, Office Action dated Nov. 2, 2015", (w/ English Translation), 7 pgs.
"Chinese Application Serial No. 201180036161.0, Response filed Mar. 14, 2016 to Office Action dated Nov. 2, 2015", (w/ English Translation of Amended Claims), 20 pgs.
"Chinese Application Serial No. 201180036161.0, Response filed Jun. 29, 2015 to Office Action dated Feb. 13, 2015", (w/ English Translation of Amended Claims), 5 pgs.
"Chinese Application Serial No. 201180036161.0, Response filed Nov. 13, 2014 to Office Action dated Apr. 30, 2014", (w/ English Translation of Amended Claims), 7 pgs.
"European Application Serial No. 11744144.4, Communication Pursuant to Article 94(3) EPC dated Jan. 21, 2016", 4 pgs.
"European Application Serial No. 11744144.4, Communication Pursuant to Article 94(3) EPC dated Apr. 29, 2014", 3 pgs.
"European Application Serial No. 11744144.4, Communication Pursuant to Article 94(3) EPC dated May 7, 2015", 4 pgs.
"European Application Serial No. 11744144.4, Response filed May 26, 2016 to Communication Pursuant to Article 94(3) EPC dated Jan. 21, 2016", 10 pgs.
"European Application Serial No. 11744144.4, Response filed Sep. 8, 2015 to Communication Pursuant to Article 94(3) EPC dated May 7, 2015", 1 pg.
"European Application Serial No. 11744144.4, Response filed Nov. 4, 2016 to Summons dated Jul. 1, 2016", 44 pgs.
"European Application Serial No. 11744144.4, Response filed Nov. 5, 2014 to Communication Pursuant to Article 94(3) EPC dated Apr. 29, 2014", 16 pgs.
"European Application Serial No. 11744144.4, Summons to Attend Oral Proceedings dated Jul. 1, 2016", 3 pgs.
"International Application Serial No. PCT/US2011/045314, International Preliminary Report on Patentability dated Jun. 6, 2013", 6 pgs.
"International Application Serial No. PCT/US2011/045314, International Search Report dated May 21, 2013", 4 pgs.
"International Application Serial No. PCT/US2011/045314, Written Opinion dated May 21, 2013", 4 pgs.
"Japanese Application Serial No. 2013-521893, Decision dated May 19, 2015", (w/ English Translation), 4 pgs.
"Japanese Application Serial No. 2013-521893, Office Action dated May 7, 2014", (w/ English Translation), 6 pgs.
"Japanese Application Serial No. 2013-521893, Written Argument and Amendment filed Nov. 6, 2014 in response to Office Action dated May 7, 2014", (w/ English Translation), 14 pgs.
"Japanese Application Serial No. 2015-187074, Office Action dated Apr. 11, 2017", (w/ English Translation), 6 pgs.
"Japanese Application Serial No. 2015-187074, Office Action dated Jul. 19, 2016", (w/ English Translation), 7 pgs.
"Japanese Application Serial No. 2015-187074, Written Argument and Amendment filed Jan. 18, 2017 to Office Action dated Jul. 19, 2016", (w/ English Translation), 20 pgs.
"Canadian Application Serial No. 2,804,630, Office Action dated Jun. 1, 2017", 6 pgs.

* cited by examiner ( a )

( b )

( c )

( d )

( e )

( f )

METHOD OF MAKING COMPOSITIONS COMPRISING MULTIPLE LAYERS

CROSS REFERENCE TO RELATED APPLICATION

This application claims the benefit of U.S. Provisional Application No. 61/367,886, filed on Jul. 27, 2010.

FIELD OF THE INVENTION

The present invention relates to a method of making personal care compositions comprising multiple layers. Specifically, the present invention relates to a method making visually attractive designs for compositions having multiple layers which are visually distinctive. The present invention also relates to personal care compositions obtained by the above mentioned method of making. The compositions of the present invention are particularly useful for providing solid personal care compositions having multiple layers of different color.

BACKGROUND OF THE INVENTION

Personal care products consist of functional elements inherent of its composition and delivery system, and emotional elements based on its visual, sensory, and olfactory characteristics. Visual characteristics are important for communicating not only the image and concept of the product, but also the function itself of the product. While visually attractive elements can be easily delivered with packaging and graphics thereof, it is also possible to provide compositions per se which have certain visually attractive elements. It would be particularly convincing to provide a personal care product having a composition made of visually distinctive layers, each layer communicating certain functions of the product.

Meanwhile, consumers seek various performances and skin/hair benefits in personal care products, such as specified look, hold, feel, fit, coverage, wear, long lasting, oil shine control UV protection, and specific treatment provided by active agents. Further, different consumer segments may seek different types of performance, such as moisturizing feel against light feel, natural look against lusterous finish, and hard hold against soft hold. To achieve these benefits, personal care compositions must accommodate various components which, depending on their physical and chemical properties, may be difficult to formulate into a single product. For example, in a foundation composition, inclusion of oil absorbing powder for oil shine control may provide a composition with unfavorable spreadability performance. By providing multiple layers of compositions in a manner such that they can be simultaneously applied, the overall composition provides benefits characteristic of each layer, which benefits would be compromised or deteriorated, if they were combined into one composition. Providing such multiple layers in a visually distinctive manner would enhance communication of the different benefits provided by the different layers.

Skin care compositions having visually distinctive multiple layers of different composition are known, for example, in PCT Publications WO 2007/032937, WO 2007/029154, WO 2007/029153, and WO 2007/029152. Besides the product designs disclosed in the art, more variety in designs is desired, however without significant additional cost for making the product.

Based on the foregoing, there is a need for a method of making personal care compositions comprising multiple layers that are visually attractive in a cost effective manner. There is further a need for a method of making personal care compositions having a variety of designs without significant change in manufacturing apparatus.

SUMMARY OF THE INVENTION

In order to provide a solution to the problems set forth above, at least one embodiment herein is directed to a method of making a personal care composition comprising providing a first layer and a second layer which each are fluid at elevated temperature; solid at ambient temperature; and visually distinctive from each other. First and second layers in a fluid state at an elevated temperature are provided in isolated vessels. The first layer is dispensed by a first nozzle and the second layer is separately dispensed by a second nozzle, while maintaining the elevated temperature, into a same package having a circle plan view shape. The middle point of the nozzles do not coincide with the Z axis running vertically through the center of the package. The dispensed composition is cooled for solidifying in the package.

DETAILED DESCRIPTION OF THE INVENTION

Figure 1:
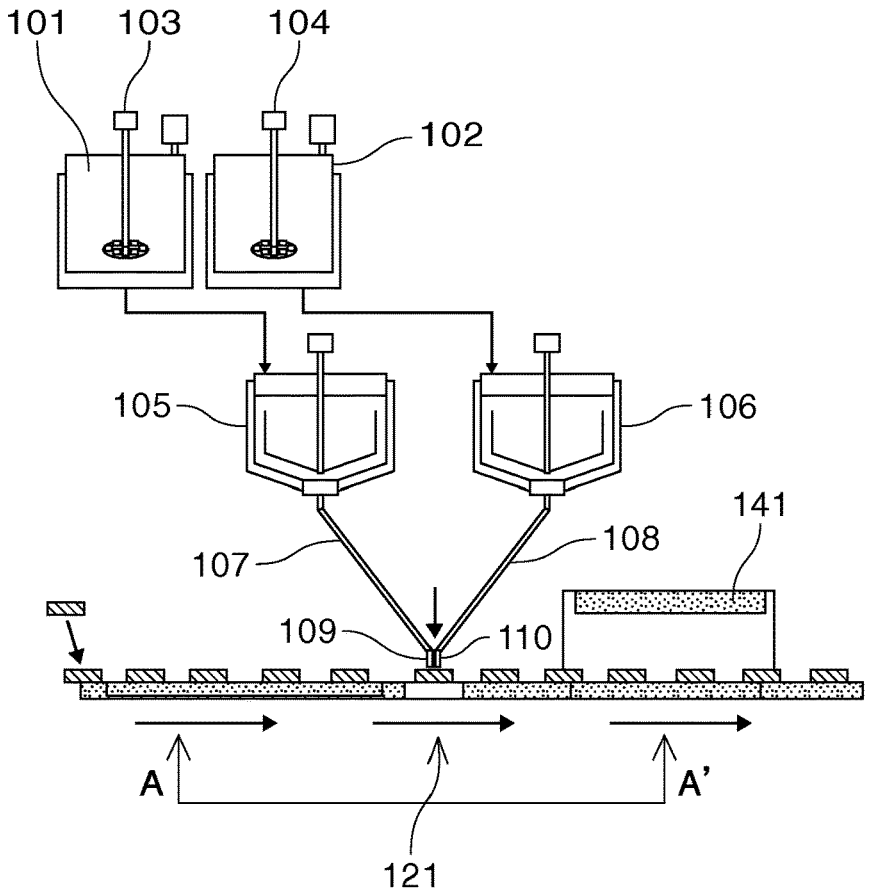
FIG. 1 is a schematic view of a preferred embodiment of the process of the present invention.

While the specification concludes with claims particularly pointing out and distinctively claiming the invention, it is believed that the present invention will be better understood from the following description.

All percentages, parts and ratios as used herein are by weight of the composition of each layer, unless otherwise specified. All such weights as they pertain to listed ingredients are based on the active level and, therefore do not include carriers or by-products that may be included in commercially available materials.

All ingredients such as actives and other ingredients useful herein may be categorized or described by their cosmetic and/or therapeutic benefit or their postulated mode of action. However, it is to be understood that the active and other ingredients useful herein can, in some instances, provide more than one cosmetic and/or therapeutic benefit or operate via more than one mode of action. Therefore, classifications herein are made for the sake of convenience and are not intended to limit an ingredient to the particularly stated application or applications listed.

Providing the First Layer and the Second Layer

The process of the present invention is for providing a personal care composition having multiple layers, namely at least a first layer and a second layer, which are visually distinctive with each other. Colorants, pearlescent agents, interference pigments, opacifiers, and other optical modifiers may be included in at least one of the first or second layers for making the layers visibly distinctive.

Providing a design of the product composition itself is visually attractive. Further, by providing multiple layers of different compositions in a manner such that they can be simultaneously applied, the overall composition may provide benefits characteristic of each layer, which benefits would be compromised or deteriorated, if they were combined into one composition. Any number of layers can be included in the overall composition. While the description herein may be directed mainly to compositions having two or three layers, the elements of the present invention may be applied to any number of layers.

The first and second layers of the present invention are fluid at elevated temperature, preferably at about 55° C. to about 90° C. and solid at ambient temperature, preferably solid at 45° C. For ease of handling, the first and second layer each has a viscosity of from about 100 mPas to about 3000 mPas when brought to a temperature of between about 55° C. and about 90° C. The first and second layers are provided in the same primary package, for example a pan, jar, or bottle, or a temporary mold for later transferring to a separate package, such as a stick applicator. Thus, the first and second layers may be provided in a manner that allows the user to simultaneously apply both layers on the skin or hair. Preferably, the first and second layers are formulated such that they exhibit a similar rheology profile when receiving pressure/heat from the skin or applicator upon use. The amounts of first and second layers to be contained in the same package are controlled to provide the desired visual appearance in a clear manner.

Referring to FIG. 1, the first and second layers described above are provided in two isolated vessels 101 and 102. Such vessel is typically a tank that is equipped with appropriate mixing means 103 and 104 for mixing and homogenizing. Then, the first and second layers are transferred into two separate filling hoppers 105 and 106, from where the first and second layers in fluid state are delivered into pipes 107, 108 which are guided to a first nozzle 109 for the first layer, and a second nozzle 110 for the second layer. The first and second nozzles terminate at a filling site 121. In the process of transferring and filling, heat-exchanging equipments are used to maintain the fluidity of the compositions, preferably at a temperature within the range of about 55° C. to about 90° C., preferably from about 60° C. to about 75° C.

The process of the present invention may be actualized by pump controlled or motor controlled flow of the nozzles. The process of the present invention described hereafter may be actualized by stabilizing the position of the nozzles. Alternatively, albeit less effective from a cost point of view, the nozzles may be moved by, for example, a robot arm, for freely depicting any design. From a different point of view, the process of the present invention is mainly for depicting the design of the upper surface of the obtained product, however, may also be so controlled for providing a design to other surfaces, particularly when the package is transparent.

Figure 3:
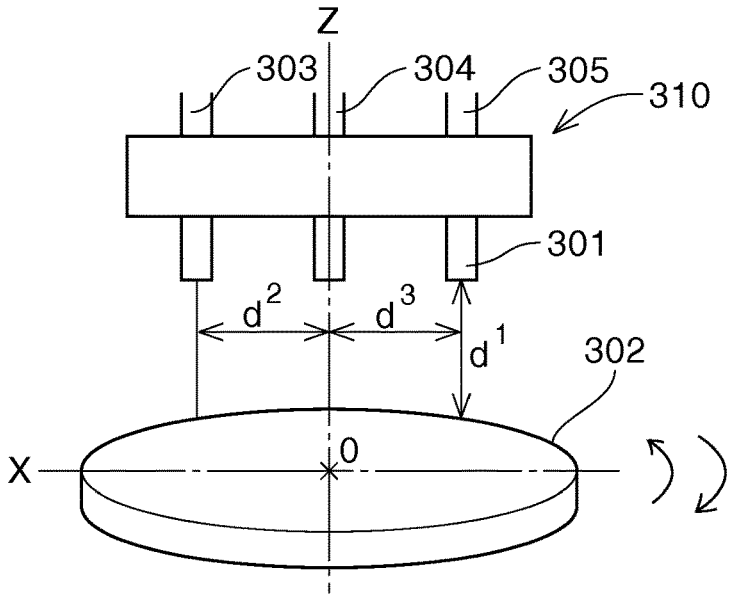
FIG. 3 (*a*)-(*f*) are schematic views of preferred embodiments of the process of the present invention focusing on the filling step.
Figure 3:
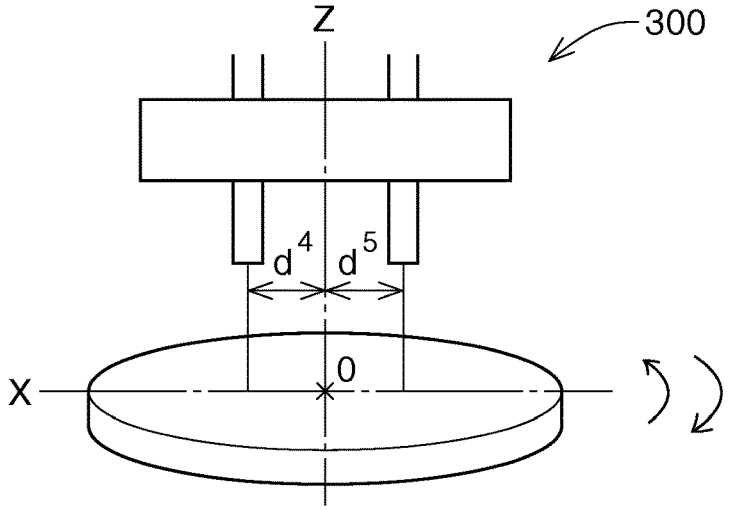
Figure 3:
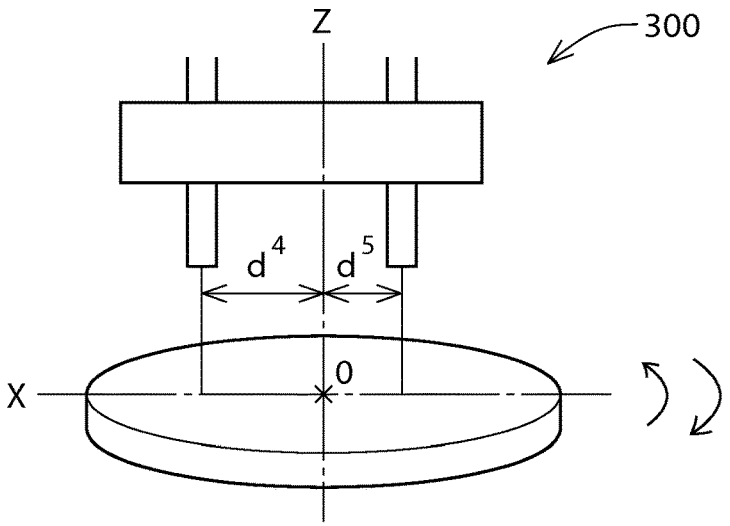
Figure 3:
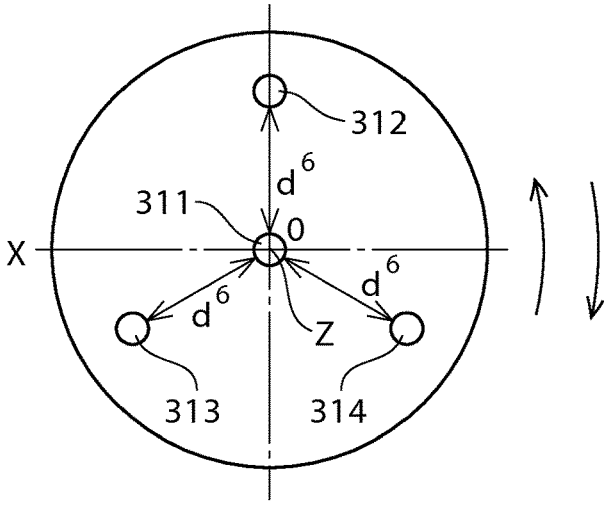
Figure 3:
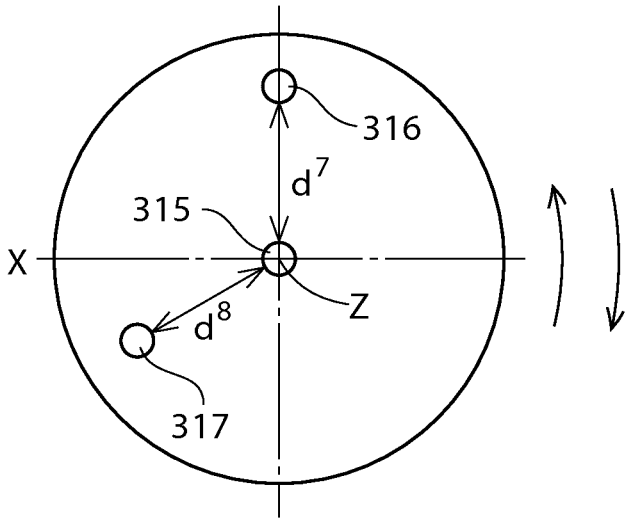
Figure 3:
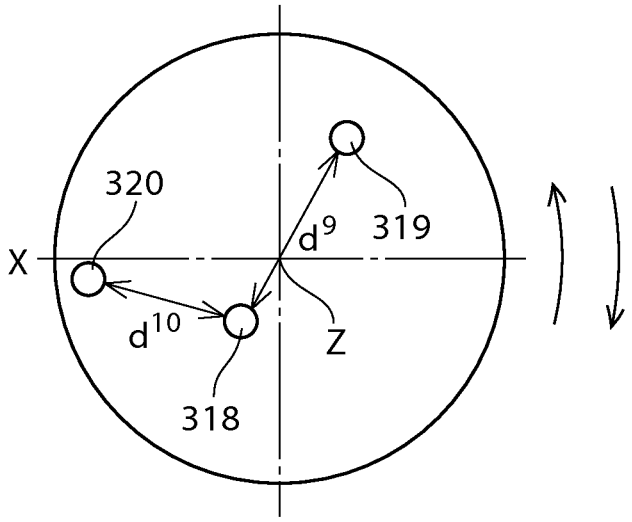

The vicinity of filling site 121 is shown in further detail in FIG. 3. Referring to FIG. 3(*a*), the distance (d1) between the nozzle tip (301) and the packaging (302) are kept as short as possible so long as the nozzle does not touch the fluidity of the surface of the composition during filling. Generally, it is known that the shorter the distance, the clearer the designs made with the process of the present invention. Regards the distance between the nozzles (d2 and d3), this is adjusted according to the desired design, so long as minimum distance is maintained to avoid unnecessary static electricity emerging between the streams of fluid compositions. The distance of d2 and d3 may or may not be the same distance.

The plurality of nozzles (303, 304, 305) may be physically bundled in a fixed distance relative to each other, for controlled manufacturing. Such bundle of nozzles is hereafter collectively referred to as a "nozzle block" (300, 310).

Dispensing, Rotating, and Cooling

Referring back to FIG. 1, the package for accommodating the first and second layers are brought to the filling site 121 by suitable means such as a moving belt conveyor. The package herein is of any shape, dimension and material that are suitable as the primary package or temporary mold of the desired product, which resists the heat at which filling is conducted, and the temperature difference upon the cooling step thereafter. The plan view shape of the package may be circle, oval, or any other shape, preferably circle or oval. Packages having circle plan view shape allow good control of the design to be provided at the filling site. Further, packages having circle plan view shape provide physical stability against, for example cracking, of the composition after it is solidified.

Figure 2:
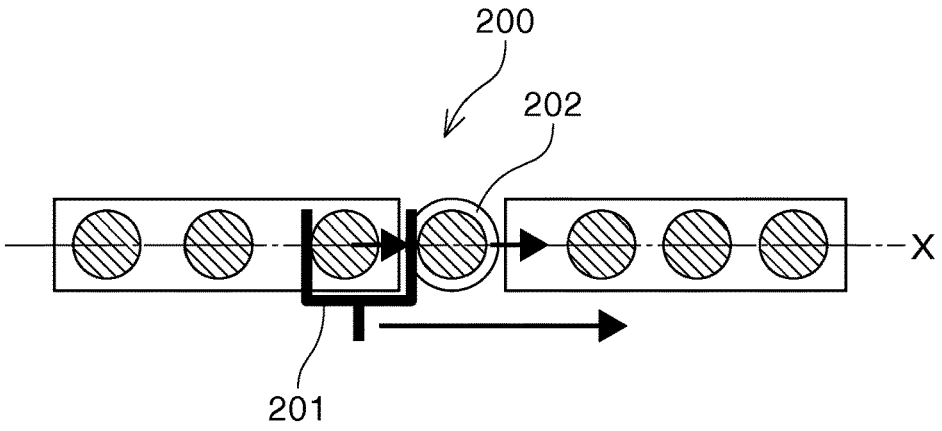
FIG. 2 is a sectional view of FIG. 1 taken at line A-A'.

Referring to FIG. 2, the package is brought to filling site 200 by means of, for example, a moving bar 201. The filling site 200 comprises a table 202 for placing the package at which the package receives the first and second layers in fluid state by the first nozzle and second nozzle, and may also comprise means for rotating the table 202. When the package has a circle plan view shape, a horizontal X axis running through the center of the package is envisioned. When the package is rotated, the present invention is described under the condition that the packaging has a center of gravity, and that such center of the packaging coincides with the vertical axis Z around which the table rotates.

The process of the present invention relates to dispensing the first and second layers through the first and second nozzles, respectively, at a certain flow rate, starting time point and completion time point. The starting time point and completion time point of dispensing may be altered by nozzle. The flow rate of at least one of the first and second layers may be altered during dispensing. The package may be rotated via rotation of the table during the dispensing. The rotation of the package may be in only one direction, or may be reversed in direction during the dispensing.

The process may further comprise the step of dispensing a third layer: which is fluid at elevated temperature and solid at ambient temperature; from a third nozzle separate from the first and second nozzles while maintaining the elevated temperature. The third layer may be visually distinctive from both the first and second layer, or may have the same visual appearance as either the first or second layer. In process of the present invention, either the first, second, and third nozzles may be horizontally aligned, or the first, second, and third nozzles may not be horizontally aligned.

By the combination of the above mentioned positioning of the nozzles, number of nozzles, flow rate of the layers, time control of the dispensing, and speed and direction of rotation of the table, a surprising variety of visually appealing designs may be created.

FIG. 3(*b*) shows dispensing of the first and second layers through first and second nozzles, respectively, wherein the first and second nozzles are positioned in equal distance (d4 and d5) from the center (O) of the package. When the layers are dispensed in equal flow rate during the same period of time with no rotation, the design of FIG. 4(*a*) is obtained. When the layers are dispensed in equal flow rate with rotation in one direction, the design of FIG. 4(*b*) is obtained. As the rotation speed is increased, the designs of FIGS. 4(*c*) and 4(*d*) are obtained.

FIG. 3(*c*) shows a similar positioning of the nozzles albeit offsetting the middle point of the first and second nozzle away from the Z axis running vertically through the center of the package. When the flow rate of dispensing the first and second nozzles are controlled such that the dispensing is completed at the same time point, and with no rotation of the package, the design of FIG. 5(*a*) is obtained. When the package is rotated, the design of FIG. 5(*b*) is obtained.

Accordingly, the present process relates to method of making a personal care composition comprising the steps of:

(a) providing a first layer and a second layer which each are fluid at elevated temperature; solid at ambient temperature; and visually distinctive from each other;

(b) providing the first and second layers in fluid state at an elevated temperature in isolated vessels;

(c) separately dispensing the first layer by a first nozzle and the second layer by a second nozzle, while maintaining the elevated temperature, into a same package having a circle plan view shape;

(d) wherein the middle point of the nozzles does no coincide with the Z axis running vertically through the center of the package; and (e) cooling the dispensed composition for solidifying in the package.

In one embodiment according to the method, the positions of the nozzles, relative to the center of the package, are maintained during dispensing.

Figure 4:
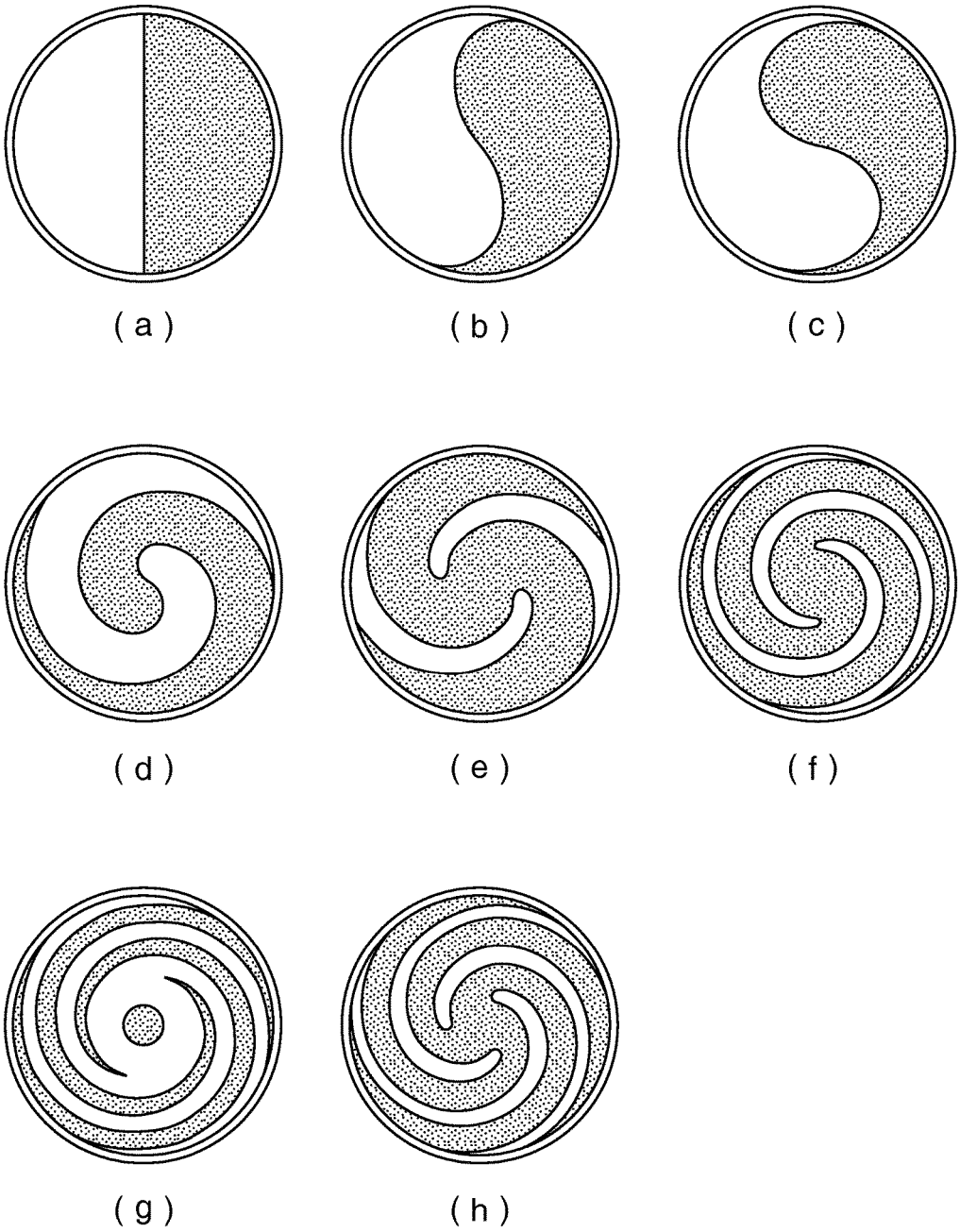
FIGS. 4(*a*) to 4(*h*) are preferred design embodiments of the present invention.
Figure 5:
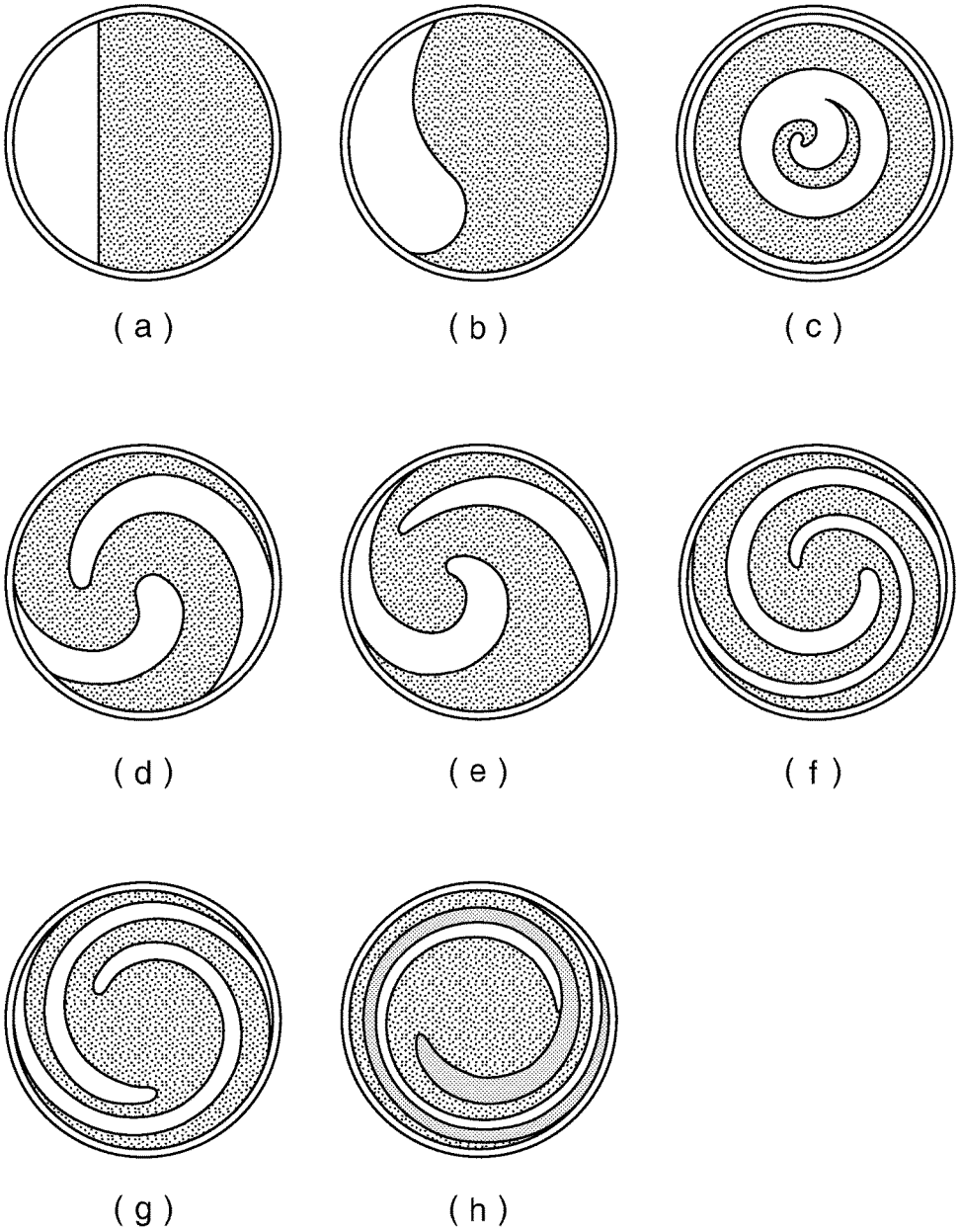
FIGS. 5(*a*) to 5(*h*) are preferred design embodiments of the present invention.

Referring now to FIG. 3(*a*), when the first, second, and third nozzles are aligned, however the nozzle block is offset such that first nozzle in the middle does not coincide with the Z axis running vertically through the center of the package (not shown), and the second and third layers are dispensed in equal flow rate with rotation, the design of FIGS. 5(*c*) and 5(*d*) are obtained, depending on the position of the nozzles and the length of rotation. Under the same condition and further moving the nozzle block of FIG. 3(*a*) along the X axis while the package is rotated, the design of FIG. 5(*e*) is obtained. Reference is now made to the original setting of FIG. 3(*a*) showing dispensing of the first, second, and third layers through first, second, and third nozzles, wherein the first nozzle is positioned coinciding with the Z axis running vertically through the center of the package, and the second and third nozzles are positioned in equal distance from the first nozzle. When the second and third layers are dispensed in equal flow rate with rotation in one direction, the design of FIG. 4(*e*) is obtained. As the rotation speed is increased, a design such as FIG. 4(*f*) is obtained. When the second and third layers are dispensed beyond a time point when the layers form a circular design in the middle, a design such as FIG. 4(*g*) is obtained.

Accordingly, the present process is related to further comprising dispensing a third layer: the third layer being fluid at elevated temperature and solid at ambient temperature; the third layer dispensed from a third nozzle separate from the first and second nozzles while maintaining the elevated temperature; wherein the first, second, and third nozzles are horizontally aligned, the first nozzle is positioned at the middle point of the second and third nozzles, and the position of the first nozzle either coincides or does not coincide with the Z axis running vertically through the center of the package.

FIG. 3(*d*) shows dispensing of the first, second, third, and fourth layers through first, second, third, and fourth nozzles, wherein the first nozzle (311) is positioned coinciding the Z axis running vertically through the center of the package, and the remaining nozzles (312, 313, 314) are positioned in equal distance (d6) from the first nozzle to form a more or less equilateral triangle with the remaining nozzles. When the second, third, and fourth layers are dispensed in equal flow rate with rotation in one direction, the design of FIG. 4(*h*) is obtained.

FIG. 3(*e*) shows dispensing of the first, second, and third layers through first, second, and third nozzles, wherein the first nozzle (315) is positioned coinciding the Z axis running vertically through the center of the package. The remaining nozzles 6 and 317 positioned either in equal distance or in different distance from the first nozzle.

FIG. 3(*f*) shows dispensing of the first, second, and third layers through first, second, and third nozzles, wherein none of the nozzles (318, 319 and 320) is positioned coinciding the Z axis running vertically through the center of the package. The second and third nozzles (319 and 320) are positioned either in equal distance or in different distance from the first nozzle (318). When the second and third nozzles (319 and 320) are positioned in different distance from the first nozzle (318), and the second and third layers are dispensed in equal flow rate with rotation, the design of FIGS. 5(*f*) and (*g*) are obtained depending on the position of the nozzles and the length of rotation. Positions of the second and third nozzles from the first nozzle, a flow rate for each layer, rotation direction starting and completion timing of dispensing are some of factors considered to generate various designs. Accordingly, the present process is related to further comprising dispensing a third layer: the third layer being fluid at elevated temperature and solid at ambient temperature; the third layer dispensed from a third nozzle separate from the first and second nozzles while maintaining the elevated temperature; wherein the first, second, and third nozzles are not horizontally aligned, the first nozzle is positioned at the middle point of the second and third nozzles, and the position of the first nozzle either coincides or does not coincide with the Z axis running vertically through the center of the package.

Figure 6:
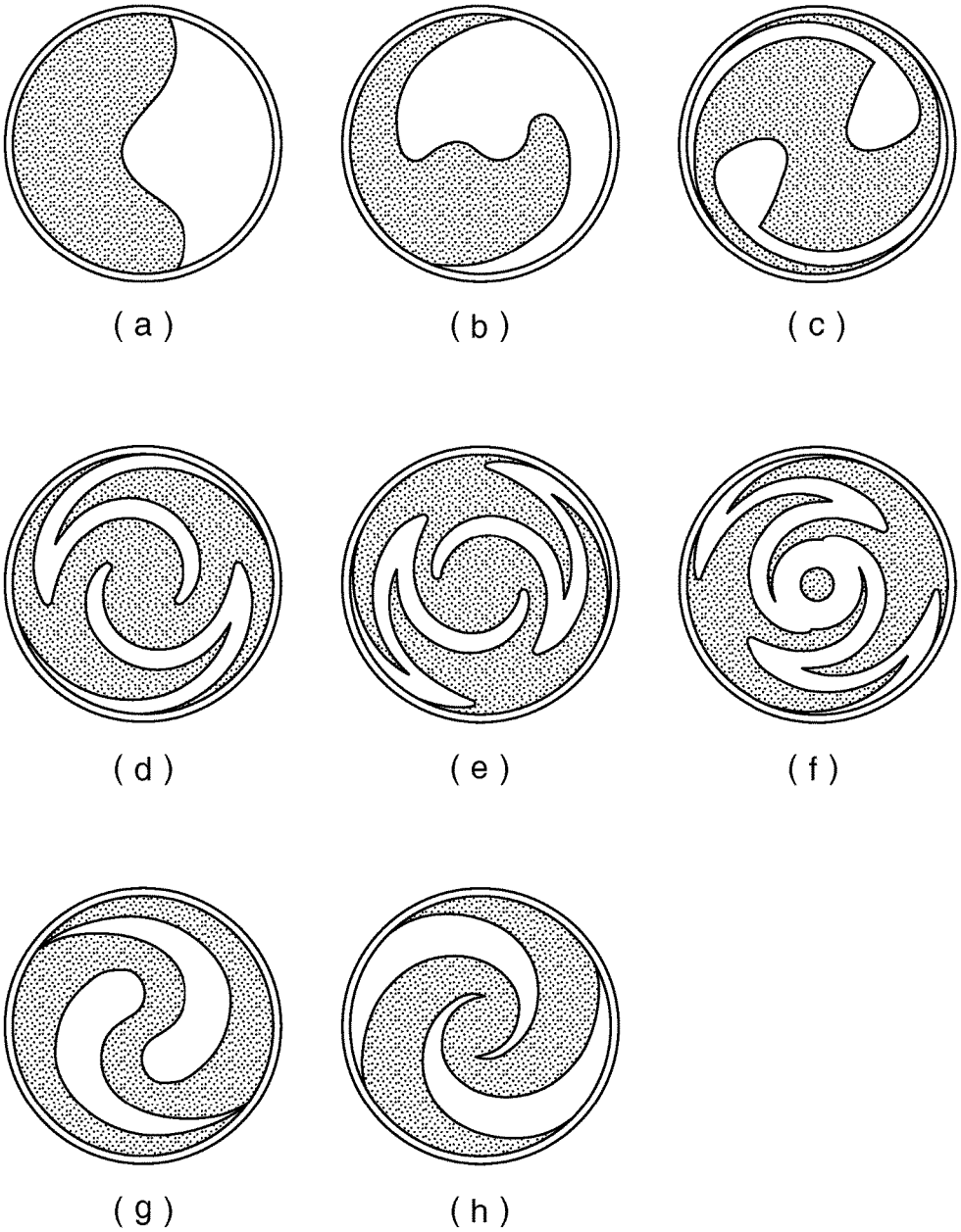
FIGS. 6(*a*) to 6(*h*) are preferred design embodiments of the present invention.

Referring back to FIG. 3(*b*), when the first and second nozzles are positioned in equal distance from the center of the package, the layers are dispensed in equal flow rate with no rotation, and one of the layers complete dispensing ahead of the other, the design of FIG. 6(*a*) is obtained. When the same dispensing is conducted with rotation in one direction, the design of FIG. 6(*b*) is obtained.

Referring back to FIG. 3(*a*), when the second and third layers are dispensed in equal flow rate with rotation in one direction, and rotation of the package is completed prior to the completion of dispensing, the design of FIG. 6(*c*) is obtained. When the second and third layers are dispensed in equal flow rate with the rotation reversed once during the dispensing, the design of FIG. 6(*d*) is obtained. When the second and third layers are dispensed in equal flow rate with the rotation reversed twice during the dispensing, the design of FIG. 6(*e*) is obtained. When the second and third layers are dispensed in equal flow rate with the rotation reversed once during the dispensing, and then dispensed beyond a time point when the layers form a circular design in the middle, a design such as FIG. 6(*f*) is obtained. When the second and third layers are dispensed in altered flow rate, respectively, with rotation in one direction, designs such as FIGS. 6(*g*) and 6(*h*) are obtained.

In one preferred embodiment, when the volumes of the layers are unequal, the flow rate of each nozzle is so controlled such that all layers are dispensed during more or less the same starting and completion time point. In another preferred embodiment, the layers may be dispensed such that the starting point and completion point are altered. Such different completion time point among layers are generally controlled to be no more than about 10 seconds, more preferably no more than about 1 second. The tolerable completion time difference depends on the flow rate, rotation speed, density, viscosity, and solidifying temperature of the layers.

When the composition of the product and package dimensions allow, it is also possible to provide a design extending in the Z direction. For example, by controlling the temperature of the first and/or second layers in the vicinity of the solidifying temperature towards the end of dispensing, a tail-like projection of the composition is created above the surface of the remaining portion of the composition. Such projection may communicate a cream like appearance.

Accordingly, the present process relates to at least one of steps (i) through (iv) taking place during the dispensing wherein the package may be rotated during dispensing:

(i) the dispensing of the first and second nozzles are started and/or completed at a different time point;
(ii) the rotation of the package is completed prior to the completion of dispensing;
(iii) the direction of rotation of the package is altered during the dispensing; or
(iv) the flow rate of at least one of the first and second layers are altered during dispensing.

Referring back to FIG. 1, the pan filled with the first and second layers are sent to the downstream moving belt conveyer, and moved through a cooling unit 141 for cooling and solidifying the composition. The thermal gradient for cooling is selected such that the physical and visual stability of the composition is maintained, for example, such that there are no cracks. Those compositions containing volatile components such as water, silicone oil, and others, are packaged in an air-tight container, such that the composition is not deteriorated during storage.

The present invention may be used for providing a water-in-oil emulsion foundation composition having 2 layers of different composition as described in the Example section below, wherein the layers are visually distinctive by having the first layer including iron oxides to provide a skin color, and the second layer devoid of coloring material. The composition provides radiant look by comprising high level of specific particle talc and methicone: SI Talc CT-20 available from Miyoshi Kasei in the second layer. The dispensing through the nozzles for providing a design is conducted at between 60° C. and 75° C. The layers may be combined in any ratio for providing the desired benefit from the separate layers.

The process of the present invention is useful for making personal care compositions that are visually attractive in a cost efficient manner. Further, the desired design for the product may be easily altered by adding the nozzles, slightly changing the position of the nozzles, and changing the rotation speed or direction of the table.

Personal Care Composition

The present invention also relates to the personal care composition obtained by the process of the present invention. The composition is particularly suitable for cosmetic products for which visual attractiveness plays an important role for purchase intent of the product. The distinctive layers may be different in visual appearance only. The distinctive layers may also be different in composition other than in visual appearance. For example, the first and second layers may have different compositions based on at least one benefit agent included in either of the layers, the benefit agent being one that provides a particular skin care or hair care benefit characteristic of the usage of the product. The benefit agent may provide a specified look, hold, feel, fit, coverage, wear, long lasting, oil shine control. UV protection, or be an active ingredient providing therapeutic or functional benefit, such as whitening agents and anti-ageing agents.

In one highly preferred embodiment, the composition is a cosmetic composition for application on the facial skin, wherein the two layers are provided with different compositions having certain benefits which, if combined into a single composition, would be compromised or deteriorated.

For example, a certain active ingredient may be included in just one layer which is rich in the solvent for dissolving the active ingredient, which solvent may provide unfavorable feel to the skin. By including the active ingredient and its solvent in the first layer, provide the second layer rich in components that provide good feel to the skin, and provide the first and second layers in a manner such that they can be simultaneously applied on the skin, the active ingredient may be delivered with less compromise in skin feel. In the case of cosmetic foundation products, for example, radiant powder such as pearl pigment is a favorable characteristic component. Inclusion of radiant powder provides the radiant look benefit. However, radiant powder needs to be included at a relatively high level to achieve a radiant look effect because other powders contained in the formulation, such as coverage titanium dioxide, may overwhelm the radiant powder effect. By including the radiant powder mainly in just one layer, the radiant effect of the overall composition can be achieved with relatively low radiant powder level. Similarly, oil absorbing powder for oil shine control such as porous silica powder may provide a composition with unfavorable spreadability performance. By including oil absorbing powder in just one layer, the spreadability performance of the overall composition may be maintained while enhancing oil shine control.

In one highly preferred embodiment, the composition is a water-in-oil emulsion foundation, such as those made of the compositions described below in the Examples section. The foundation product obtained by the process above with compositions in the Examples section has distinctive beige and white layers in attractive design.

Examples

The following examples further describe and demonstrate the preferred embodiments within the scope of the present invention. The examples are given solely for the purpose of illustration, and are not to be construed as limitations of the present invention since many variations thereof are possible without departing from its spirit and scope.

The following are water-in-oil emulsion make-up foundation compositions suitably made by the process of the present invention.

Compositions of the First and Second Layers

| No | Components | First Layer | Second Layer |
|---|---|---|---|
| 1 | Cyclopentasiloxane *1 | 26.90 | 26.9 |
| 2 | PEG-9 Polydimethylsiloxyethyl Dimethicone *2 | 1.50 | 1.50 |
| 3 | Tocopheryl Acetate *3 | 0.50 | 0.50 |
| 4 | Isotridecyl Isononanoate *4 | 2.00 | 2.00 |
| 5 | Sorbitan Monoisostearate *5 | 1.50 | 1.50 |
| 6 | Iron Oxide and Cyclopentasiloxane and Dimethicone and Disodium | 3.00 | — |

-continued

| No | Components | First Layer | Second Layer |
|---|---|---|---|
| | Hydrogenated Glutamate *6 | | |
| 7 | Titanium Dioxide and Talc and Methicone *7 | 14.00 | — |
| 8 | Titanium Dioxide and Methicone *8 | — | 3.00 |
| 9 | Titanium Dioxide and Dimethicone and Aluminium Hydroxide and Stearic Acid *9 | 3.00 | 3.00 |
| 10 | Silica and Methicone *10 | 2.00 | — |
| 11 | Talc and Methicone *11 | 3.00 | 15.00 |
| 12 | Talc and Methicone *12 | — | 4.00 |
| 13 | Water | 29.00 | 27.00 |
| 14 | Niacinamide *13 | 4.00 | 4.00 |
| 15 | Preservative | 0.45 | 0.45 |
| 16 | Panthenol *14 | 0.25 | 0.25 |
| 17 | Butylene Glycol *15 | 5.00 | 5.00 |
| 18 | Water and Myritol 318 and Butylene Glycol and Tocoherol and Ascorbyl Tetraisopalmitate and Paraben and Carbopol 980 and DNA *16 | — | 2.00 |
| 19 | Candelilla Wax *17 | 2.00 | 2.00 |
| 20 | Ceresin *18 | 1.90 | 1.90 |

Definitions of Components

*1 Cyclopentasiloxane: SH245 available from Dow Corning

*2 PEG-9 Polydimethylsiloxyethyl Dimethicone: KF-6028 available from Shin-Etsu Chemical Co., Ltd.

*3 Tocopheryl Acetate: DL-α-tocopheryl Acetate available from Eisai

*4 Isotrideeyl Isononanoate: Crodamol TN available from Croda

*5 Sorbitan Monoisostearate: SPAN L120-LQ-(RB) available from Croda

*6 Iron Oxide and Cyclopentasiloxane and Dimethicone and Disodium Hydrogenated Glutamate: SA/NAI-Y-10/D5 (70%), SA/NAI-R-10/D5 (65%) and SA/NAI-B-10/D5 (75%) available from Miyoshi Kasei

*7 Titanium Dioxide and Talc and Methicone: SI-T-CR-50Z available from Miyoshi Kasei

*8 Titanium Dioxide and Methicone: SI-TTO-S-3Z available from Miyoshi Kasei

*9 Titanium Dioxide and Dimethicone and Aluminum Hydroxide and Stearic acid: SAST-UFTR-Z available from Miyoshi Kasei

*10 Silica and Methicone: SI-SILDEX H-52 available from Miyoshi Kasei

*11 Talc and Methicone: SI Talc CT-20 available from Miyoshi Kasei

*12 Talc and Methicone: SI Talc JA13R LHC available from Miyoshi Kasei

*13 Niacinamide: Niacinamide available from Reilly Industries Inc.

*14 Panthenol: DL-Panthenol available from Alps Pharmaceutical Inc.

*15 Butylene Glycol: 1,3-Butylene Glycol available from Kyowa Hakko Kogyo

*16 Water and Myritol 318 and Butylene Glycol and Tocoherol and Ascorbyl Tetraisopalmitate and Paraben and Carbopol 980 and DNA: SMARTVECTOR UV available from Coletica

*17 Candelilla Wax: Candelilla wax NC-1630 available from Cerarica Noda

*18 Ceresin: Ozokerite wax SP-1021 available from Strahl & Pitsh

Preparation Method

The composition including the first layer and second layer compositions are prepared as follows, respectively:

1) Mixing components numbers 1 through 6 with suitable mixer until homogeneous to provide a silicone phase.)

2) Mixing components numbers 7 through 12 with suitable mixer until homogeneous to provide a pigment mixture which is then pulverized using a pulverizer. Adding the pigment mixture into the silicone phase with a suitable mixer until homogeneous.

3) Dissolving components number 13 through 18 with suitable mixer until all components are dissolved to provide a water phase which is then added into the silicone phase and pigment mixture to make an emulsion at room temperature using homogenizer.

4) Adding components number 19 and 20 into the emulsion which is then heated to dissolve at 85° C. in a sealed tank.

5) Dispensing the first layer and second layer into a foundation pan according to the processes described herein above, 6) Finally, filling the emulsion into an air-tight container and setting into a foundation compact.

Preferably, the second layer composition is divided into two steams to make a second and third layer, and dispensed with the first layer to provide one of the following designs: FIG. 4 (*e*), (*f*), (*g*), (*h*), FIG. 5 (*a*), (*b*), (*c*), (*d*), (*e*), FIG. 6 (*c*), (*d*), (*e*), (*f*), (*g*), (*h*).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of making a personal care composition comprising a first layer, a second layer and a third layer which each are fluid at elevated temperature and solid at ambient temperature, at least the first layer and second layer being visually distinctive from each other, the method comprising:

providing a first composition and a second layer composition in fluid state at an elevated temperature in isolated vessels;

dividing the second layer composition into two streams to make the second layer and the third layer;

separately dispensing the first layer by a first nozzle, the second layer by a second nozzle, and the third layer by a third nozzle into a package while maintaining the elevated temperature, the first nozzle, the second nozzle, and the third nozzle being spaced apart and physically bundled at a fixed distances relative to each other to form a nozzle block, the first nozzle and the second nozzle having respective unique non-zero distances to a Z-axis running vertically through the center of the package during dispensing and the third nozzle at a non-zero distance with respect to the Z-axis during dispensing, wherein at least two of the first nozzle, the second nozzle, and the third nozzle are fixed at unique non-zero distances to a nozzle axis passing through the center of the nozzle block that is parallel to the Z-axis;

moving the nozzle block along an X-axis running horizontally through the center of the package during at least a portion of the dispensing; and cooling the dispensed compositions for solidifying in the package.

2. The method of claim 1, wherein the first layer composition and the second layer composition are different in composition other than in visual appearance.

3. The method of claim 1, further comprising rotating the package around the Z axis for at least a portion of period during the dispensing.

4. The method of claim 1, further comprising controlling a flow rate of each of the first nozzle, second nozzle, and third nozzle such that all layers are dispensed at about a same starting and completion time point when at least one of the first layer, second layer, and third layer have a different volume from the remaining layers.

5. The method of claim 1, wherein the layers are solid at 45° C.

6. The method of claim 1, wherein the elevated temperature is from about 55° C. to about 90° C.

* * * * *